US006758169B2

(12) United States Patent
Suzuki et al.

(10) Patent No.: US 6,758,169 B2
(45) Date of Patent: Jul. 6, 2004

(54) ENGINE GENERATOR

(75) Inventors: Misao Suzuki, Tokyo (JP); Hideki Tomiyama, Tokyo (JP); Tadao Kuwahara, Tokyo (JP); Shinichi Okazaki, Tokyo (JP)

(73) Assignee: Fuji Jukogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/268,576

(22) Filed: Oct. 10, 2002

(65) Prior Publication Data

US 2003/0070652 A1 Apr. 17, 2003

(30) Foreign Application Priority Data

Oct. 11, 2001 (JP) ..... P. 2001-314321
Oct. 11, 2001 (JP) ..... P. 2001-314322

(51) Int. Cl.[7] ..... F02B 43/08
(52) U.S. Cl. ..... 123/3; 322/1; 290/1 A
(58) Field of Search ..... 123/3, 198 E, 123/2; 322/1; 290/1 A

(56) References Cited

U.S. PATENT DOCUMENTS 4,493,390 A 1/1985 Pagano et al.
5,197,426 A * 3/1993 Frangesch et al. ..... 123/198 E
6,039,009 A * 3/2000 Hirose ..... 123/2

FOREIGN PATENT DOCUMENTS

JP 2000-213361 8/2000 ..... F02B/63/04

* cited by examiner

*Primary Examiner*—Tony M. Argenbright
*Assistant Examiner*—Katrina B. Harris
(74) *Attorney, Agent, or Firm*—Darby & Darby

(57) ABSTRACT

A frame type engine generator having an engine, a generator connected with the engine and driven by the engine and a supporting frame for supporting the engine and generator therein is closed at the front surface of the supporting frame with a control panel, closed at the rear surface thereof with a muffler cover and closed at the top surface thereof with a fuel tank. To raise a noise reduction performance of the engine generator, the left side surface of the supporting frame is closed with a left panel and the right side surface thereof is closed with a right panel. The left and right panels have a double-walled structure including an inner panel and an outer panel, respectively. The left and right panels are detachably attached to the supporting frame through a rubber seal, respectively.

7 Claims, 11 Drawing Sheets

ENGINE GENERATOR

BACKGROUND OF THE INVENTION

1. Field of the Invention

The present invention relates to an engine generator and more particularly to an engine generator supported by a supporting frame.

2. Discussion of Prior Arts

A frame type engine generator in which a forced air cooled engine and a generator driven by the engine are mounted on a supporting frame is generally used. The frame type engine generator is advantageous in weight, the number of components and manufacturing cost, because the engine generator is not enclosed by panels and the like and has a simple construction. For example, a frame type engine generator disclosed in Japanese Patent Application Laid-open No. Toku-Kai-2000 213361 is closed on the front and rear sides with a control panel and a muffler cover, respectively but is open on left and right sides.

On the other hand, the frame type engine generator has a disadvantage that it makes much noises through the openings. Hence, in case where the engine generator is used in a place where noise emission is strictly restricted, a soundproof type engine generator whose all openings are closed is employed. This soundproof type engine generator is constituted by many components different from those of the frame type engine generator to obtain effects of noise reduction and hence an advantage of the frame type engine generator such as small number of components is lost. Accordingly, users sometimes employ the frame type and sometimes employ the soundproof type according to work situations. Further, manufactures must supply both types of engine generators to markets.

SUMMARY OF THE INVENTION

It is an object of the present invention to provide an engine generator capable of obtaining a large noise reduction performance and a shock resistance performance when needed while the advantages of a frame type engine generator, namely, compact size and low cost are retained.

In order to achieve the object, an engine generator having an engine, a generator connected with the engine and driven by the engine, a supporting frame for supporting the engine and generator therein, a fuel tank for closing a top surface of the supporting frame, a control panel for closing a front surface of the supporting frame in front of the generator, and a muffler cover for closing a rear surface of the supporting frame in the rear of the engine, comprises a left panel detachable from the supporting frame for closing a left side surface of the supporting frame, a right panel detachable from the supporting frame for closing a right side surface of the supporting frame and a plate detachable from the supporting frame for closing an under surface of the supporting frame. The left panel has a double walled structure including an inner panel and an outer panel and is enclosed at the outer periphery thereof by a rubber seal. Similarly, the right panel has a double walled structure including an inner panel and an outer panel and is enclosed at the outer periphery thereof by a rubber seal. The left and right panels are attached to the supporting frame through the rubber seal.

DESCRIPTION OF PREFERRED EMBODIMENT

Figure 1:
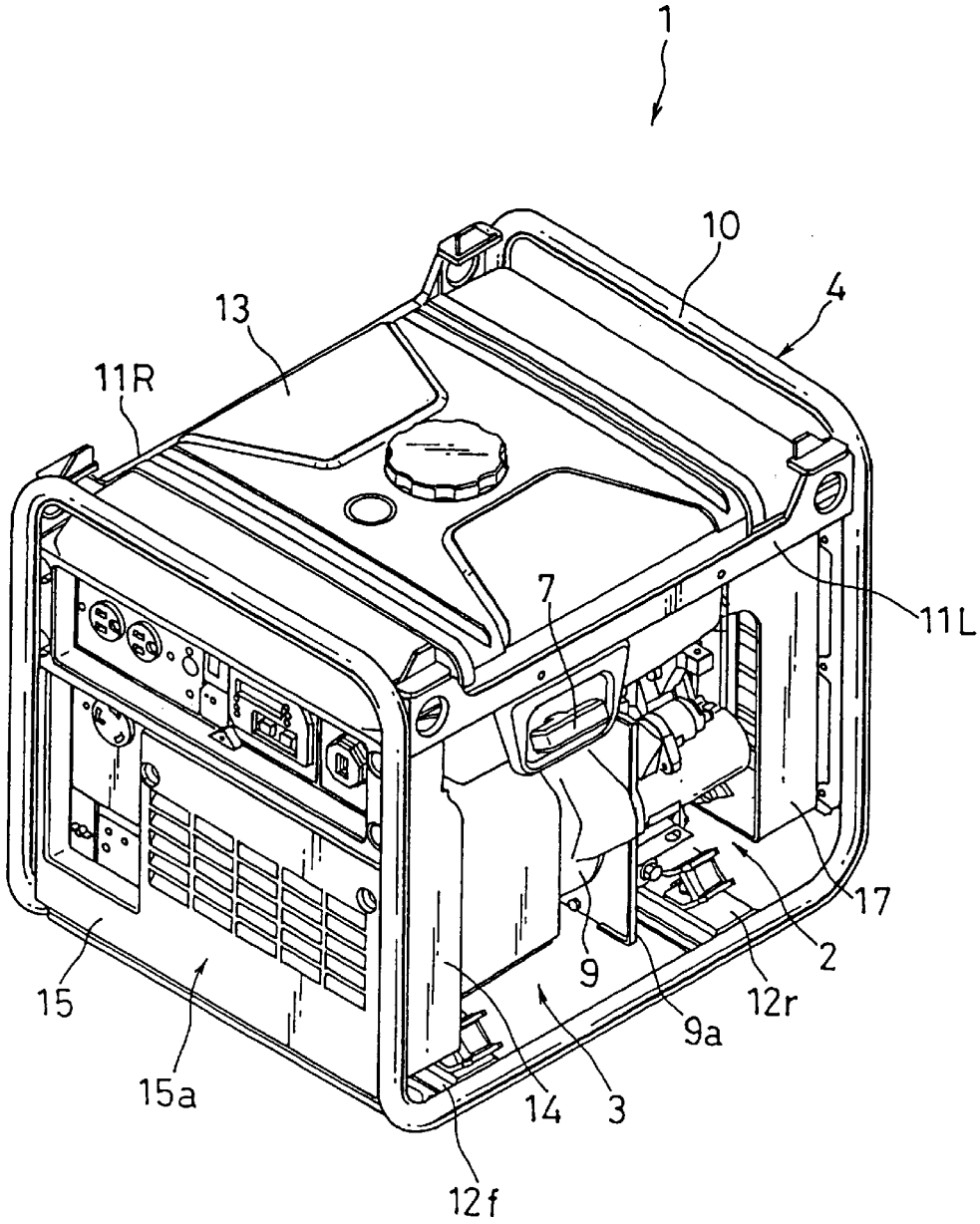
FIG. 1 is a perspective view of an engine generator when viewed from a front left side of the engine generator.
Figure 2:
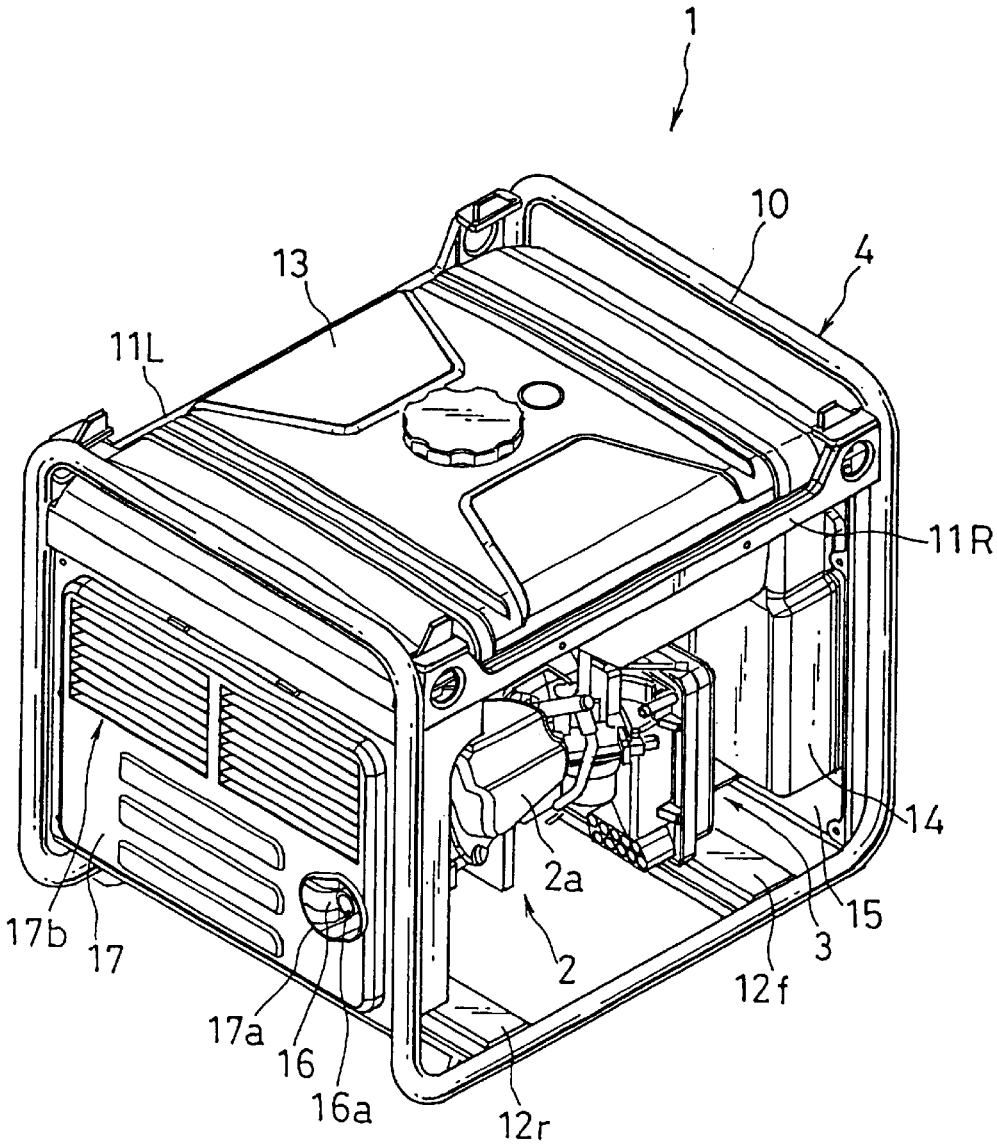
FIG. 2 is a perspective view of the engine generator when viewed from a rear right side of the engine generator.

Referring to the drawings FIGS. 1 and 2, reference numeral 1 denotes a frame type engine generator comprising a single cylinder forced air cooled engine, a generator and a supporting frame 4 for supporting the engine and the generator therein. A cylinder head 2*a* of the engine 2 is slanted to the right to reduce the height of the engine generator in the supporting frame 4.

Figure 3:
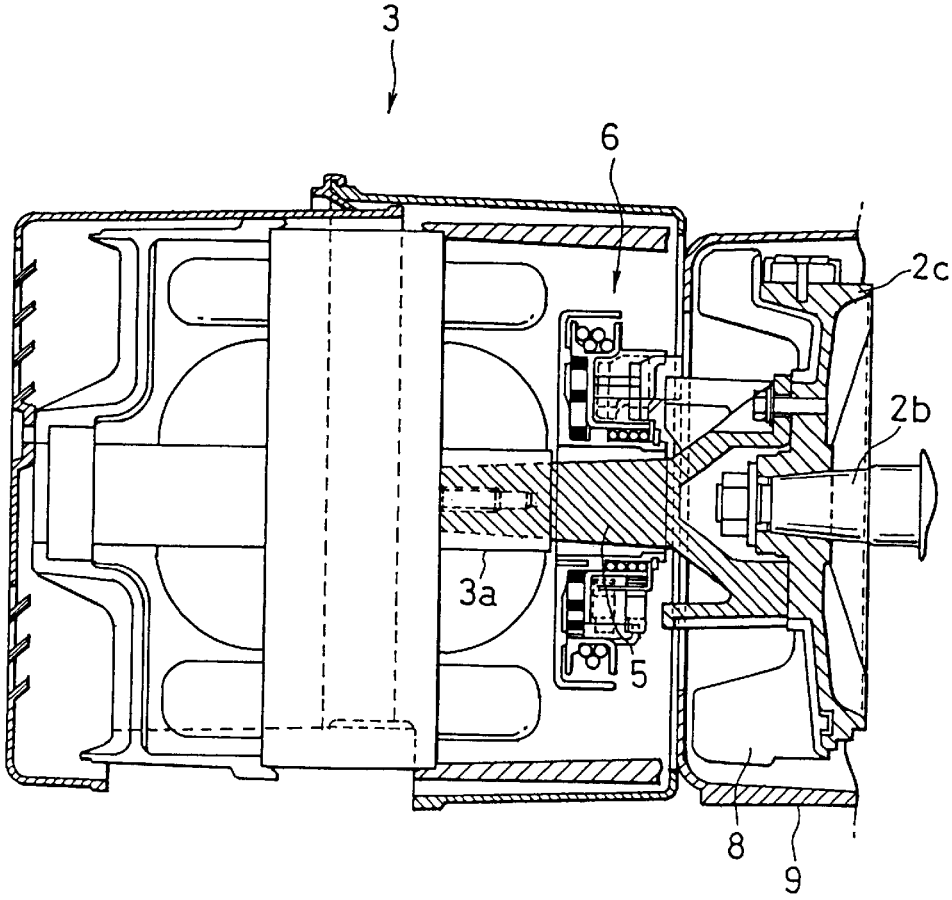
FIG. 3 is an explanatory diagram showing a connecting portion of the engine and the generator.

Further, as shown in FIG. 3, a crankshaft 2*b* of the engine 2 extends toward the generator 3 in front of the engine 2 and a flywheel 2*c* is mounted on the crankshaft 2*b*. The flywheel 2*c* is connected with a connecting shaft 5 for connecting the flywheel 2*c* and a rotor of the generator 3. Reference numeral 6 of FIG. 3 denotes a recoil starter. The recoil starter 6 starts the engine 2 by pulling a recoil grip 7 shown in FIG. 1.

The flywheel 2*c* incorporates a cooling fan 8 for sending cooling air from the generator 3 toward the engine 2. There is provided a fan cover 9 around the cooling fan 8. A partition 9*a* is integrally formed with the fan cover 9 to separate the engine 2 side from the generator 3 side. Further, a rubber seal (not shown) is provided on the outer edge of the partition 9*a*.

The supporting frame 4 is formed by upward bending respective front and rear portions of a rectangular pipe frame 10. A left channel 11*l* longitudinally connects front left and rear left top corners of the supporting frame 4 and a right channel 11*r* longitudinally connects front right and rear right top corners of the supporting frame 4. Further, a fuel tank 13 is secured between the respective left and right channels 11*l*, 11*r* in such a manner as covering the top surface of the supporting frame 4.

Further, a front base channel 12*f* laterally connects left and right lower pipe frames of the supporting frame 4 and a rear base channel 12*r* laterally connects the left and right pipe frames. The generator 3 is supported mainly by the front base channel 12*f* and the engine 2 is supported mainly by the rear base channel 12*r*.

A control box 14 having an output terminal and accommodating miscellaneous control equipments is provided on the front side of the supporting frame 4 and a control panel 15 covers the control box 14 and a forefront part of the supporting frame 4.

The control box 14 has an opening portion at a lower part thereof, that is, in front of the generator 3 and a louver 15*a* is formed on the control box 14 so as to introduce outside air therethrough towards the generator 3.

There is provided a muffler 16 of the engine 2 on the rear side of the supporting frame 4. The rear surface of the supporting frame 4 is closed with a muffler cover 17. A hole 17*a* is provided on the muffler cover 17 and an outlet pipe 16*a* of the muffler 16 is exposed outside through the hole 17*a*. Further, a louver 17*b* is formed on the muffler cover 17 in order to rearwardly discharge air inside of the engine generator 1 therethrough.

Figure 4:
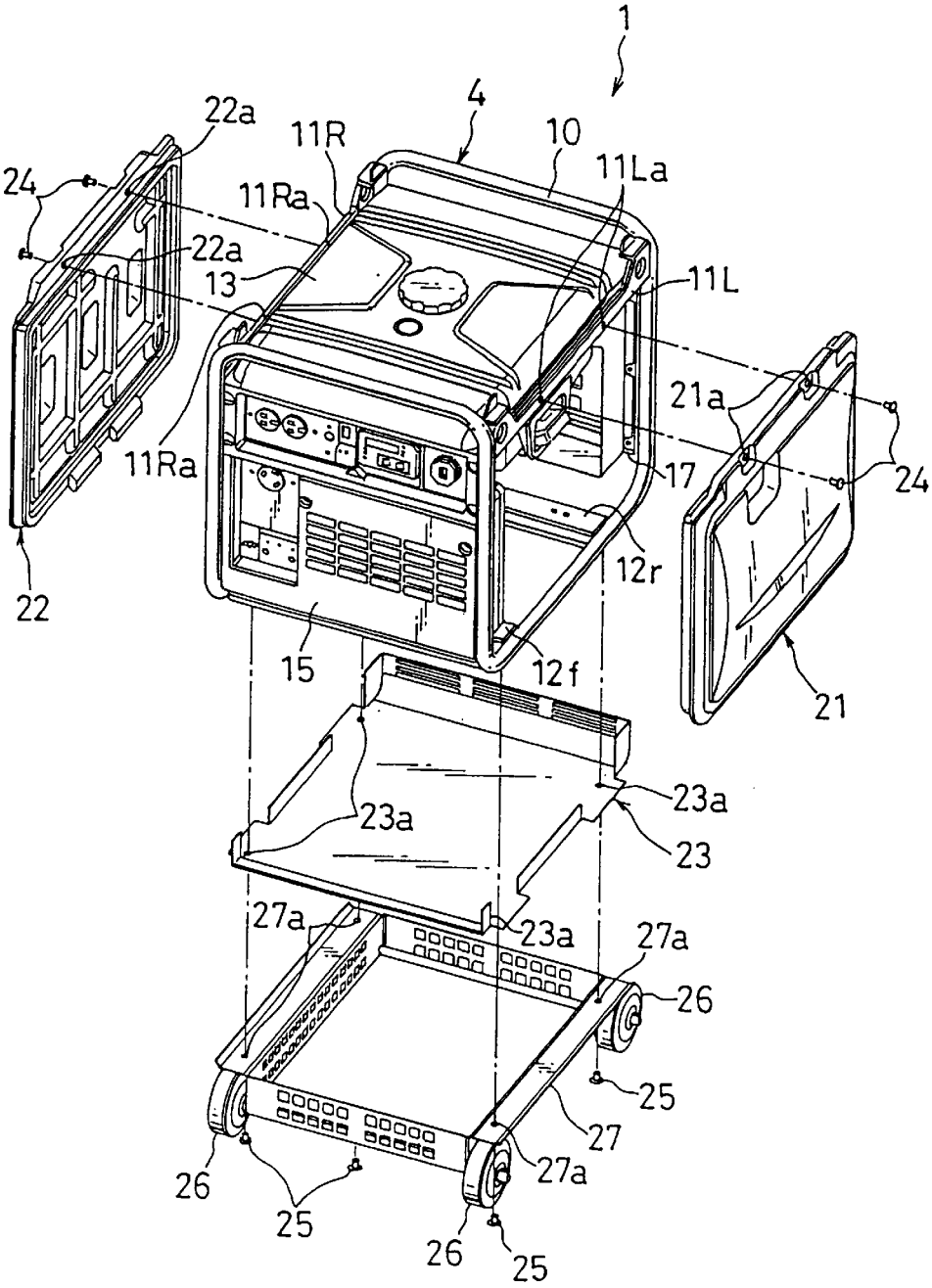
FIG. 4 is an exploded perspective view to illustrate an installation of shield panels on the engine generator.

Further, as shown in FIG. 4, the engine generator 1 is closed at left and right lateral side surfaces thereof with left and right panels 21, 22 respectively and is closed at the bottom surface thereof with a base plate 23. Thus, since the frame type engine generator 1 is closed at all six surfaces thereof, an excellent noise insulation performance can be obtained.

Figure 5:
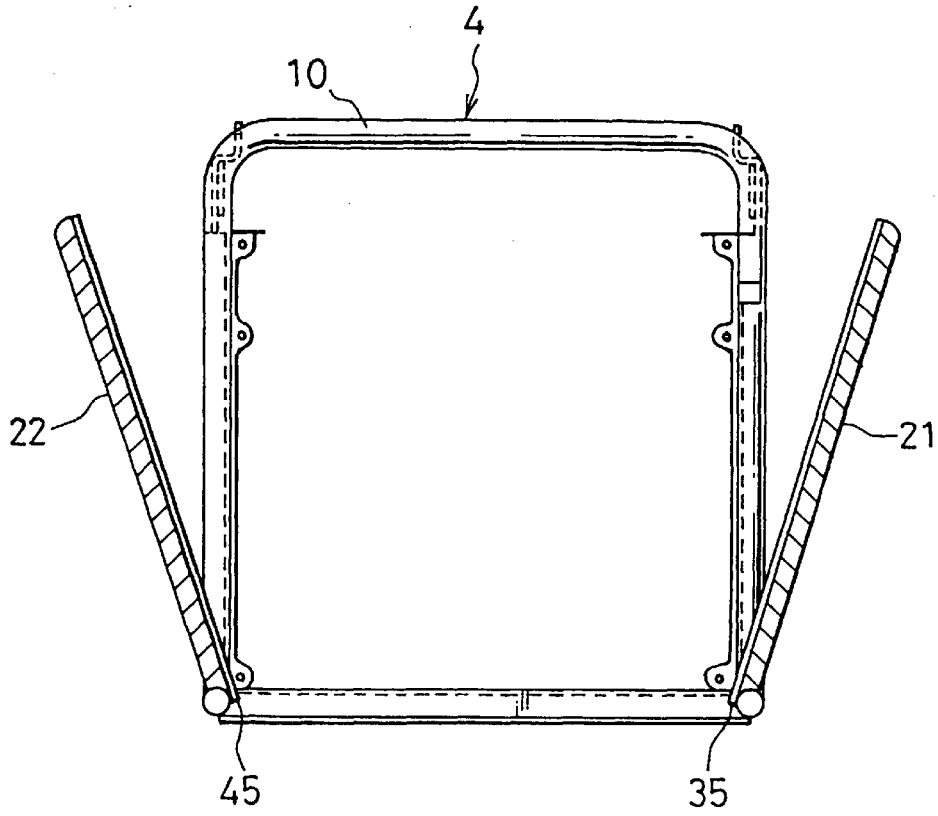
FIG. 5 is an explanatory diagram showing the way of installing left and right shield panels on the engine generator.

As shown in FIG. 5, the left and right panels 21, 22 have hooks 35, 45 at lower ends thereof respectively. The left and right panels 21, 22 are hooked on the pipe frame 10 of the supporting frame 4 by utilizing the hooks 35, 45 respectively. Upper ends of the left and right panels 21, 22 are attached to the left and right channels 11*l*, 11*r* by threading screws 24 into tapped holes 11*la*, 11*ra* of the left and right channels 11*l*, 11*r* through screw holes 21*a*, 22*a* provided on the left and right panels 21, 22, respectively. Thus, the left and right lateral side of the engine generator 1 are closed.

Further, the base plate 23 is attached to the front and rear base channels 12*f*, 12*r* by threading bolts 25 into tapped holes provided on the base channels 12*f*, 12*r* through four bolt holes 23*a* provided at four corners thereof. Thus, the under surface of the engine generator 1 is closed with the base plate 23.

Further, a caster 26 is attached to each corner of the base plate 23 through a caster plate 27. The caster plate 27 is concurrently attached to the front and rear base channels 12*f*, 12*r* through bolt holes 27*a* provided on the caster plate 27 when the base plate 23 is attached using the bolts 25.

Figure 6:
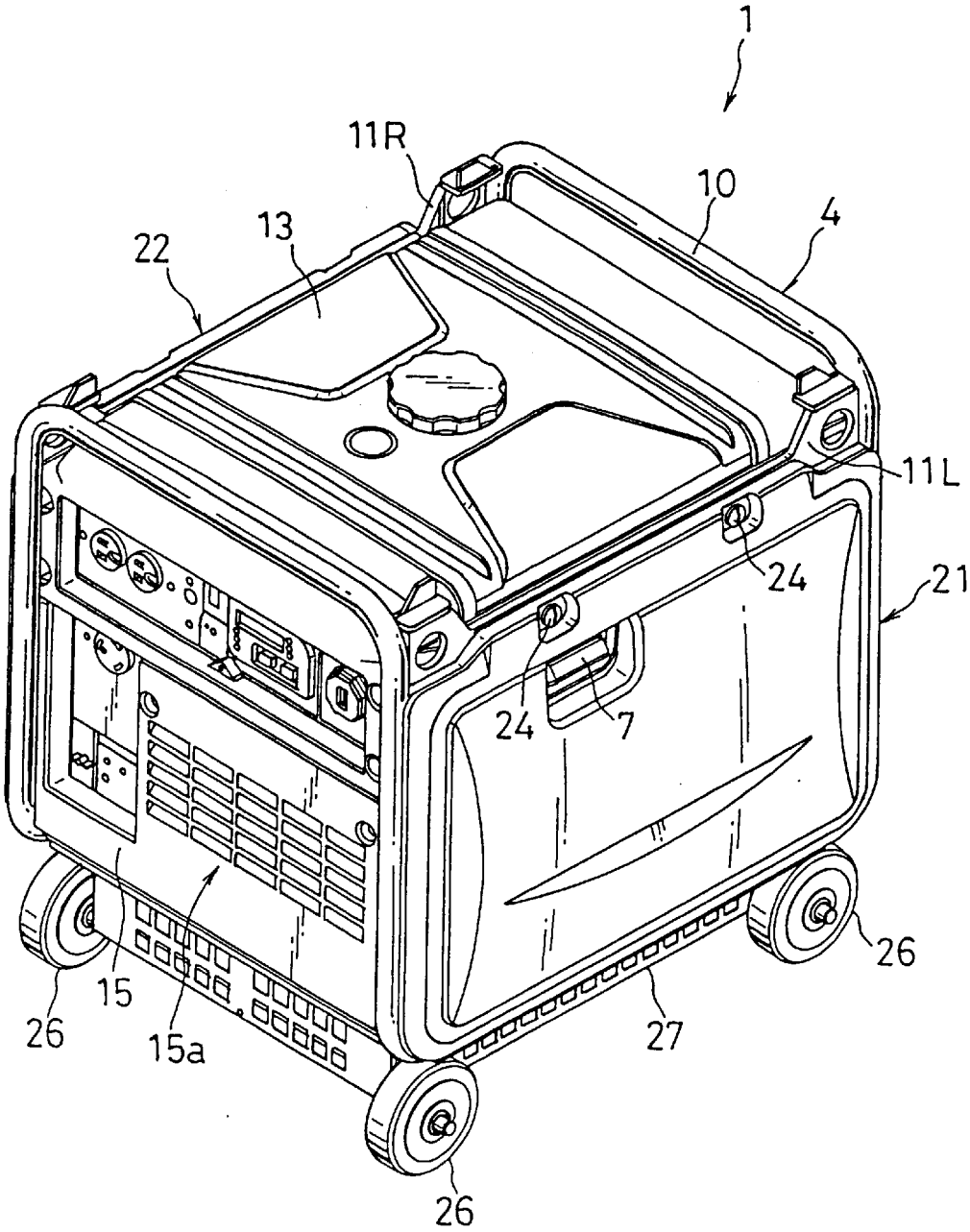
FIG. 6 is a perspective view of the engine generator with the shield panels when viewed from a front left side of the engine generator.
Figure 7:
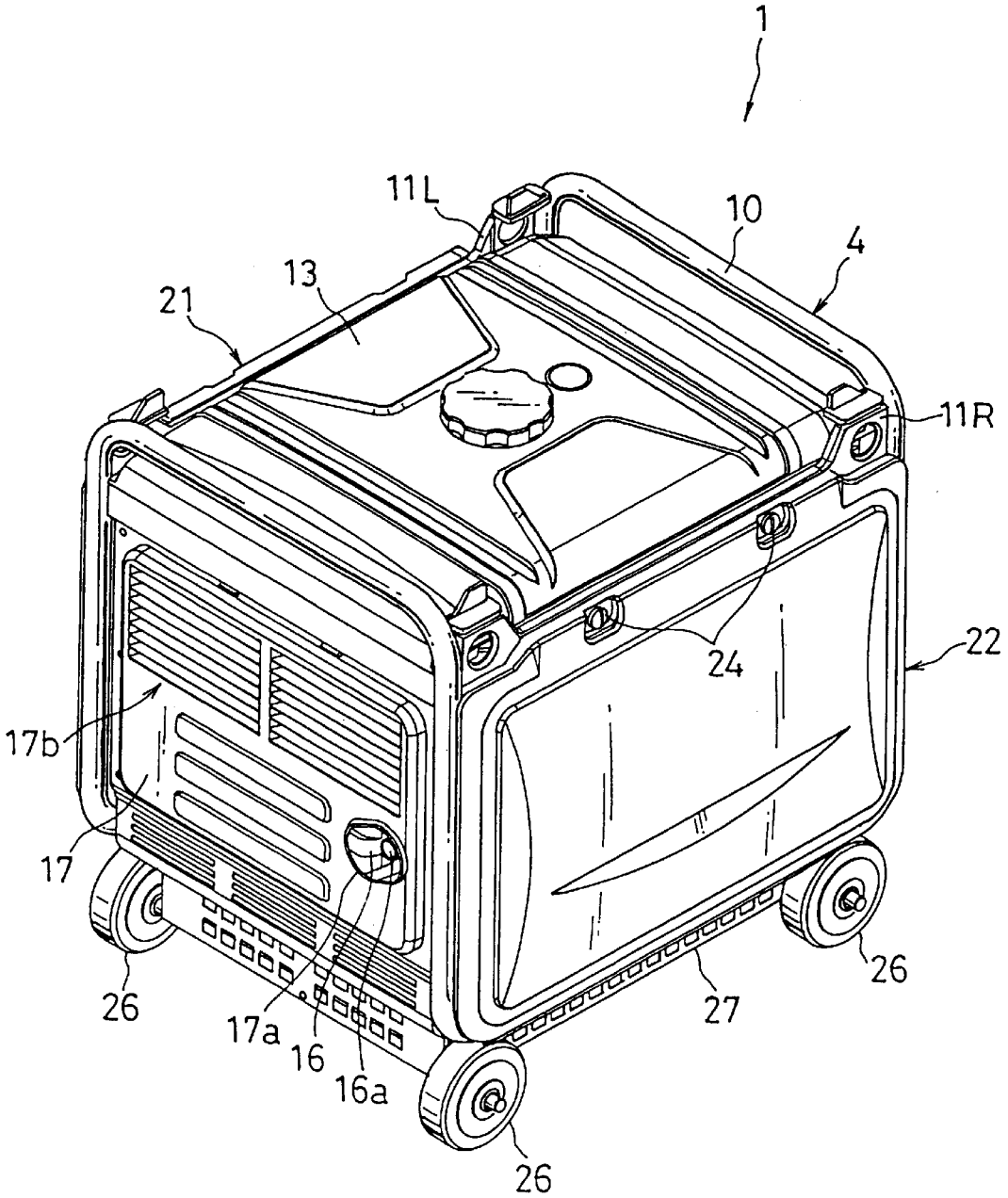
FIG. 7 is a perspective view of the engine generator with the shield panels when viewed from a rear right side of the engine generator.

FIGS. 6 and 7 show the engine generator 1 when the left and right panels 21, 22, the base plate 23 and the caster plates 27 are attached to the engine generator 1 shown in FIGS. 1 and 2, respectively.

Figure 8:
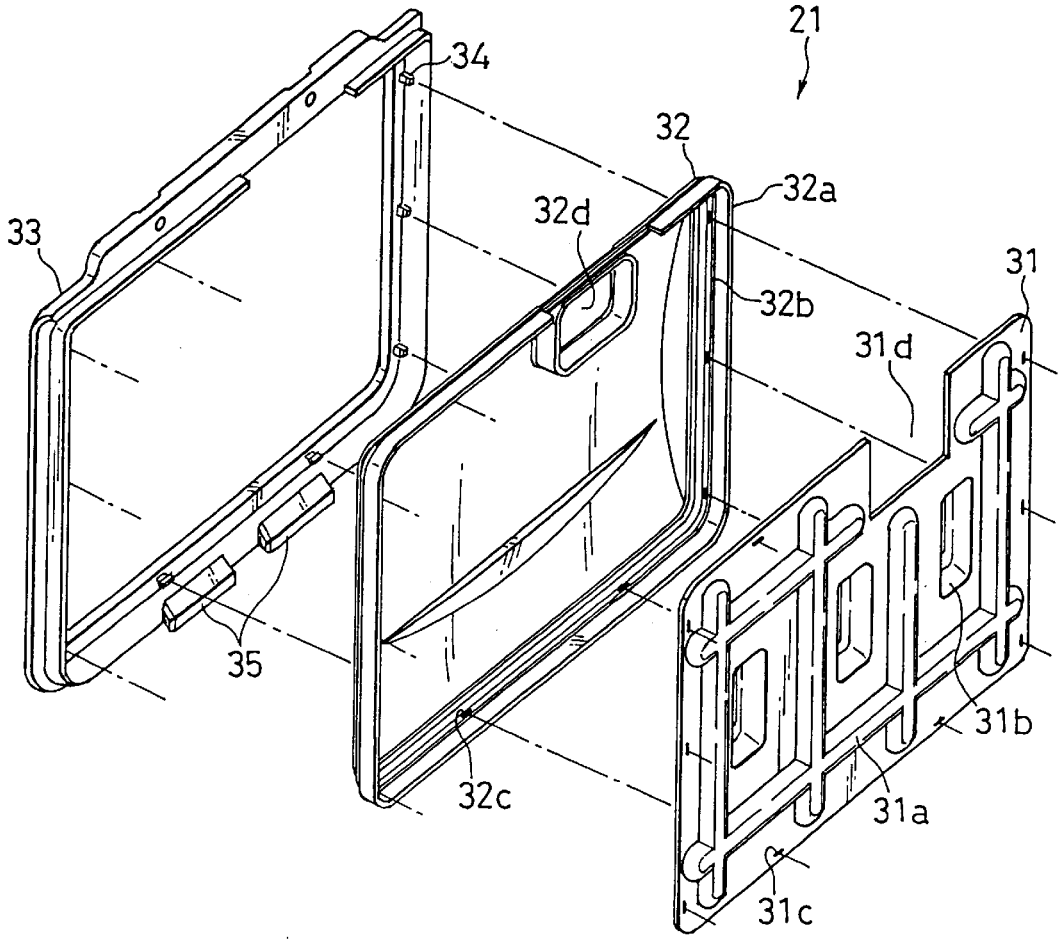
FIG. 8 is a view showing the construction of a left shield panel.
Figure 9:
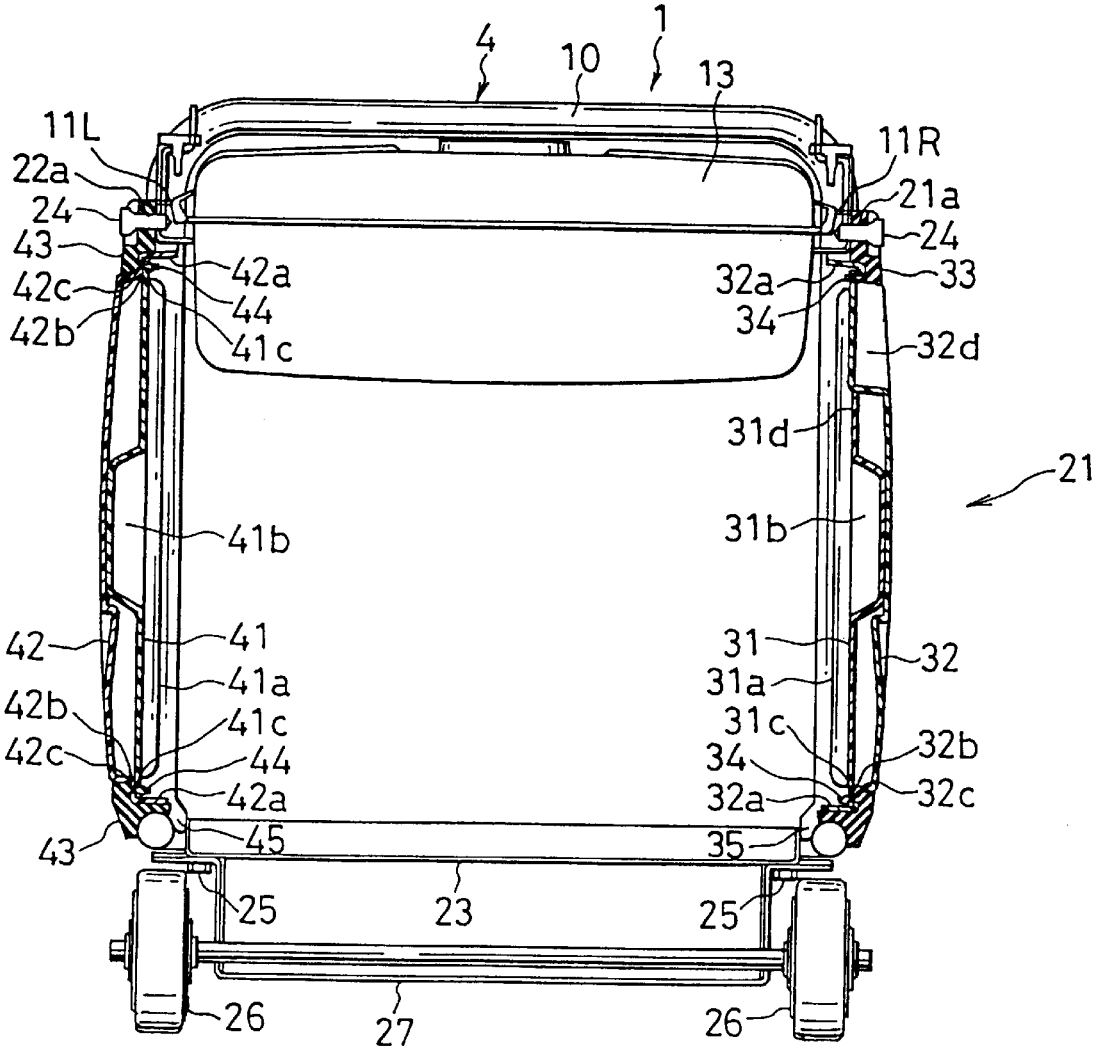
FIG. 9 is a partially vertically sectional view of the shield panels attached to the engine generator.
Figure 10:
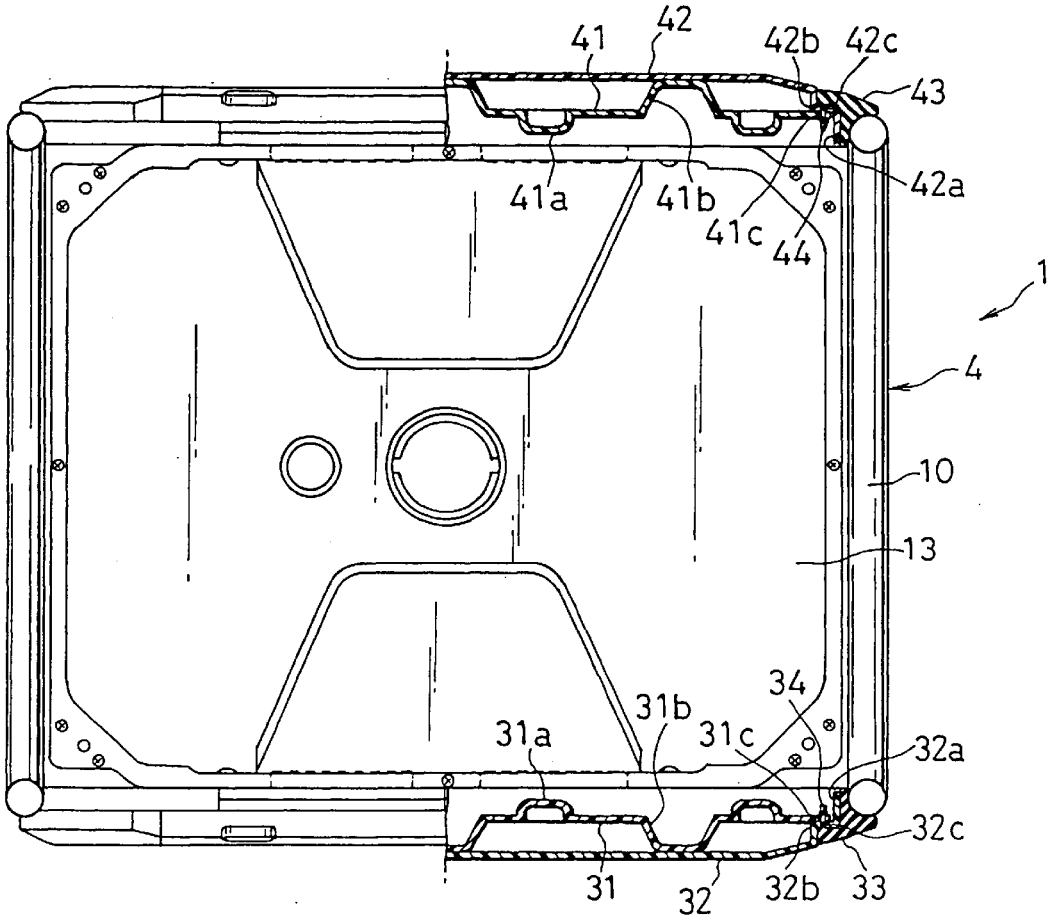
FIG. 10 is a partially horizontally sectional view of the shield panels attached to the engine generator.

As shown in FIGS. 8, 9 and 10, the left panel 21 has a double-walled structure comprising an inner panel 31 and an outer panel 32. The inner panel 31 is connected with the outer panel 33 by a rubber seal 33 enclosing the outer periphery thereof.

That is, the inner panel 31 is fabricated of plastic molding having a plurality of inwardly protruded sections 31*a* and outwardly protruded sections 31*b* for the purpose of raising strength of the left panel 21.

Further, as will be described hereinafter, there are provided a plurality of slots 31*c* in the vicinity of the periphery edge of the inner panel 31. Projections 34 of the rubber seal 33 are fitted to those slots 31*c* and thus the inner panel 31 is fixed to the outer panel 32.

Further, a window 31*d* is formed in the upper edge of the inner panel 31 to accommodate the recoil grip 7.

The outer panel 32 is also fabricated of plastic molding whose outer surface is molded in an outwardly convex manner. Further, the outer panel 32 has an inwardly protruded section extending longitudinally in the middle part thereof. This inwardly protruded section has an aesthetic effect and at the same time a purpose for raising strength of the outer panel 32.

Figure 11:
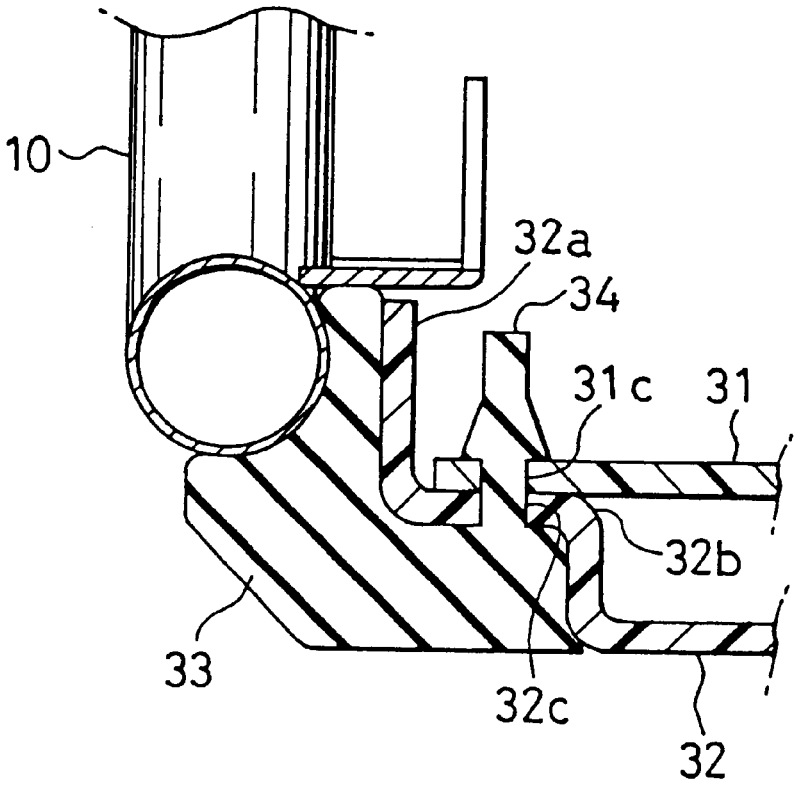
FIG. 11 is an explanatory diagram showing a sealing rubber between an inner panel and an outer panel.

As shown in FIG. 11, a flange section 32*a* is formed along the outer periphery of the outer panel 32. The flange section 32*a* has a small slant necessary for plastic molding, that is, a draft angle. Further, a step section 32*b* is provided on the flange section 32*a*. The outer periphery of the inner panel 31 contacts the step section 32*b* so as to accommodate the inner panel 31 in the outer panel 32.

A plurality of slots 32*c* are provided on the step section 32*b* of the outer panel 32. Further, a plurality of slots 31*c* are provided at a position identical to the position of the respective slots 32*c* in the vicinity of the outer periphery of the inner panel 31. Further, the projections 34 inwardly extending from the rubber seal 33 are fitted to the slots 31*c* and 32*c* to connect the inner panel 31 with the outer panel 32.

Further, the outer panel 32 has also a window 32*d* at a position corresponding to the position of the recoil grip 7.

The rubber seal 33 is formed so as to enclose the outer periphery of the outer panel 32. There are provided a projection 34 on the upper side, two projections 34 on the lower side, three projections 34 on the front and rear sides respectively.

The projection 34 of the rubber seal 33, as shown in FIG. 11, is formed such that the forefront part thereof is tapered off so as to be easily fitted to the slots 31*c*, 32*c*. Further, the projection 34 is shaped so as to be firmly held after being fitted.

Further, a hook 35 is formed at the lower part of the rubber seal 33 to hook the pipe frame 10 of the supporting frame 4.

On the other hand, the right panel 22 is formed in the same way as the left panel 21, comprising an inner panel 41 and an outer panel 42 which are connected with each other through a rubber seal 43 enclosing the outer periphery of the right and left panels 22, 21.

The inner panel 41 is fabricated of plastic molding having a plurality of inwardly protruded sections 41*a* and outwardly protruded sections 41*b* for the purpose of raising strength of the right panel 22.

Further, there are provided a plurality of slots 41*c* in the vicinity of the periphery edge of the inner panel 41. Projections 44 which will be described hereinafter of the rubber seal 43 are fitted to those slots 41*c* and thus the inner panel 41 is combined with the outer panel 42.

The outer panel 42 is also fabricated of plastic molding of which outer surface is molded in an outwardly convex manner. Further, the outer panel 42 has an inwardly protruded section extending longitudinally in the middle part thereof. This inwardly protruded section has an aesthetic effect and at the same time a purpose for raising strength of the outer panel 42.

A flange section 42*a* is formed along the outer periphery of the outer panel 42. The flange section 42*a* has a small slant necessary for plastic molding, that is, a draft angle. Further, a step section 42*b* is provided on the flange section 42*a*. The outer periphery of the inner panel 41 contacts the step section 42*b* so as to accommodate the inner panel 41 in the outer panel 42.

A plurality of slots 42*c* are provided on the step section 42*b* of the outer panel 42 in the same manner as in the inner panel 41. Further, a plurality of slots 41*c* are provided at a position identical to the position of the respective slots 42*c* in the vicinity of the outer periphery of the inner panel 41. Further, the projections 44 inwardly extending from the rubber seal 43 are fitted to the slots 41*c* and 42*c* to connect the inner panel 41 with the outer panel 42.

The rubber seal 43 is formed so as to enclose the outer periphery of the outer panel 42. There are provided a projection 44 on the upper side, two projections 44 on the lower side, three projections 44 on the front and rear sides respectively.

The projection 44 of the rubber seal 43 is formed such that the forefront part thereof is tapered off so as to be easily fitted to the slots 41*c*, 42*c*. Further, the projection 44 is shaped so as to be firmly held after being fitted.

Further, a hook 45 is formed at the lower part of the rubber seal 43 to hook the pipe frame 10 of the supporting frame 4.

Further, when the outer panel 42 is fitted to the rubber seal 43, since the flange section 42*a* provided along the outer periphery of the outer panel 42 is slightly slanted outwardly, the flange section 42*a* can be easily fitted to the rubber seal 43. Further, since the slant of the flange section 42*a* provided a tension outwardly on the rubber seal 43, the outer panel 42 is firmly held by the rubber seal 43. As a result, the noise reduction performance of the engine generator is enhanced.

When thus constituted left and right panels 21, 22 attached to the supporting frame 4, since the rubber seals 33, 43 have a specified amount of deformation between the pipe frame 10 and the flange sections 32*a*, 42*a* or between the left and right channels 11*l*, 11*r* and the flange sections 32*a*, 42*a*, an excellent noise insulation effect is obtained.

Further, since the rubber seals 33, 43 temporarily hold the pipe frame 10, screws 24 can be easily fastened on the left and right panels 21, 22.

Further, since the left and right panels 21, 22 are fabricated of plastic, high frequency noise can be effectively reduced. Further, since an air layer is provided between the inner panels 31, 41 and the outer panels 32, 42, noise can be effectively reduced.

Further, in spite of the frame type engine generator, in case where situations require noise reductions, an engine generator having an excellent noise reduction performance can be obtained only by attaching the left and right panels 21, 22 and the base plate 23 to the frame type engine generator 1.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. An engine generator having an engine, a generator connected with said engine and driven by said engine, a supporting frame for supporting said engine and said generator therein, comprising:

a fuel tank for closing a top surface of said supporting frame;

a control panel for closing a front surface of said supporting frame in front of said generator;

a muffler cover for closing a rear surface of said supporting frame in the rear of said engine;

a left panel for detachably closing a left side surface of said supporting frame;

a right panel for detachably closing a right side surface of said supporting frame; and a base plate for detachably closing an under surface of said supporting frame.

2. The engine generator according to claim 1, wherein said left panel has a double-walled structure including an inner panel and an outer panel and is enclosed at the outer periphery thereof with a rubber seal.

3. The engine generator according to claim 2, wherein said left panel is attached to said supporting frame through said rubber seal.

4. The engine generator according to claim 1, wherein said right panel has a double walled structure including an inner panel and an outer panel and is enclosed at the outer periphery thereof with a rubber seal.

5. The engine generator according to claim 4, wherein said left panel is attached to said supporting frame through said rubber seal.

6. The engine generator according to claim 2, wherein at least one of said inner and outer panels is made of plastic.

7. The engine generator according to claim 4, wherein at least one of said inner and outer panels is made of plastic.

* * * * *